US010036985B2

(12) United States Patent
Murakami

(10) Patent No.: US 10,036,985 B2
(45) Date of Patent: Jul. 31, 2018

(54) IMAGE FORMING APPARATUS EQUIPPED WITH A FIXING DEVICE

(71) Applicant: KONICA MINOLTA, INC., Chiyoda-ku, Tokyo (JP)

(72) Inventor: Masanori Murakami, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/252,763

(22) Filed: Aug. 31, 2016

(65) Prior Publication Data

US 2017/0068193 A1 Mar. 9, 2017

(30) Foreign Application Priority Data

Sep. 3, 2015 (JP) ..... 2015-174069

(51) Int. Cl.
*G03G 15/20* (2006.01)

(52) U.S. Cl.
CPC ..... *G03G 15/2042* (2013.01)

(58) Field of Classification Search
CPC ..... G03G 21/1685; G03G 15/2078
See application file for complete search history.

(56) References Cited

U.S. PATENT DOCUMENTS 4,179,211 A * 12/1979 Kimura ..... G03G 15/30 399/161
5,386,278 A * 1/1995 Maeyama ..... A46D 1/00 15/207.2
2013/0108397 A1* 5/2013 Naruse ..... G03G 21/1619 411/511
2013/0209145 A1* 8/2013 Hasegawa ..... G03G 15/2053 399/328

(Continued)

FOREIGN PATENT DOCUMENTS

JP 2006-133596 A 5/2006
JP 2006-308644 A 11/2006

(Continued)

OTHER PUBLICATIONS

JP_2011022263_A_T Machine Translation, Urano, Japan, Feb. 2011.*

(Continued)

*Primary Examiner* — Victor Verbitsky
(74) *Attorney, Agent, or Firm* — Buchanan Ingersoll & Rooney PC

(57) ABSTRACT

A fixing device includes a heat rotating body, a pressure applying rotating body, a heat leveling rotating body for equalizing temperature distribution of a rotating body which is one of the heat rotating body and the pressure applying rotating body, and a brush rotating body which includes a plurality of fibers for cleaning a surface of the heat leveling rotating body. A switching unit switches a contact state between the heat leveling rotating body and the rotating body which is the one of the heat rotating body and the pressure applying rotating body, between a state in which the heat leveling rotating body makes contact with the rotating body and a state in which the heat leveling rotating body is separated from the rotating body, by moving integrally the heat leveling rotating body and the brush rotating body making contact with each other.

7 Claims, 11 Drawing Sheets

(56) References Cited

U.S. PATENT DOCUMENTS

| | | | | |
|---|---|---|---|---|
| 2014/0064754 | A1* | 3/2014 | Hara | G03G 15/2039 399/43 |
| 2014/0193181 | A1 | 7/2014 | Nakamura et al. | |
| 2015/0261150 | A1* | 9/2015 | Hasegawa | G03G 15/2039 399/69 |

FOREIGN PATENT DOCUMENTS

| | | | | |
|---|---|---|---|---|
| JP | 2006308644 | A | * | 11/2006 |
| JP | 2008-040310 | A | | 2/2008 |
| JP | 2010-72328 | A | | 4/2010 |
| JP | 2010-097017 | A | | 4/2010 |
| JP | 2011-022263 | A | | 2/2011 |
| JP | 2012-247759 | A | | 12/2012 |
| JP | 2014-048624 | A | | 3/2014 |
| JP | 2014-149515 | A | | 8/2014 |

OTHER PUBLICATIONS

JP_2006308644_A_T MachineTranslation, Japan, Nov. 2006, Haniyu.*

Office Action (Notification of Reasons for Refusal) dated Dec. 26, 2017, by the Japanese Patent Office in corresponding Japanese Patent Application No. 2015-174069, and an English Translation of the Office Action (8 pages).

Office Action (Notification of Reasons for Refusal) dated Oct. 3, 2017, by the Japanese Patent Office in corresponding Japanese Patent Application No. 2015-174069, and an English Translation of the Office Action. (9 pages).

* cited by examiner

FIG. 5

| BRUSH PULLING OUT FORCE (gf) | | | | | | | | | | | | | | | | | | | |
|---|---|---|---|---|---|---|---|---|---|---|---|---|---|---|---|---|---|---|---|
| 2 | 3 | 4 | 5 | 6 | 7 | 8 | 9 | 10 | 11 | 12 | 13 | 14 | 15 | 16 | 17 | 18 | 19 | 20 |
| FAIL | FAIL | FAIL | FAIR | EXCEL-LENT | EXCEL-LENT | EXCEL-LENT | EXCEL-LENT | EXCEL-LENT | EXCEL-LENT | EXCEL-LENT | EXCEL-LENT | FAIR | FAIL | FAIL | FAIL | FAIL | FAIL | FAIL |
| DIRT NOT REMOVED | | | GOOD | | | | | | | | | | HEAT LEVELING ROLLER WORN DOWN DIRT RETRANSFERRED TO PRESSURE ROLLER | | | | | |

FIG. 11

| BRUSH DIAMETER (d) | | | | |
|---|---|---|---|---|
| 5 | 10 | 15 | 20 | 75 |
| FAILURE | EXCELLENT | EXCELLENT | EXCELLENT | FAILURE |
| PULLING OUT FORCE UNSTABLE, SINCE BLUSH ELASTICITY IS WEAK | GOOD | | | HEAT LEVELING ROLLER WORE DOWN (COAT WORE DOWN) |

IMAGE FORMING APPARATUS EQUIPPED WITH A FIXING DEVICE

This application is based on Japanese Patent Application No. 2015-174069 filed with the Japan Patent Office on Sep. 3, 2015, the entire content of which is hereby incorporated by reference.

BACKGROUND OF THE INVENTION

Field of the Invention

This invention relates to a fixing device and an image forming apparatus equipped with the fixing device. More specifically, this invention relates to a fixing device equipped with a heat leveling rotating body and a brush rotating body, and an image forming apparatus equipped with the fixing device.

Description of the Related Art

As electrophotography image forming apparatuses, there are an MFP (Multi Function Peripheral) having a scanner function, a facsimile function, a copying function, a function of a printer, a data transmitting function and a server function, a facsimile device, a copying machine, a printer, and so on.

According to generic image forming processes of an image forming apparatus, a surface of an image supporting body is uniformly electrostatic charged by an electrostatic charging device. Then, an expose device exposes the image supporting body in accordance with image information. Herewith, an electrostatic latent image is formed on the surface of the image supporting body. The electrostatic latent image is developed as a toner image, since toner electrostatically adheres to the image supporting body, due to the action of a developing device. The toner image formed on the surface of the image supporting body is transferred onto a secondary transfer belt, and is conveyed to a transfer unit. The toner image on the secondary transfer belt is electrostatically transferred to a sheet conveyed by a sheet conveying unit from a paper feeding tray, by a transfer unit. And then, the sheet is conveyed to a fixing device. In the fixing device, a nip portion between a heating roller and a pressure roller heats the sheet and applies pressure on the sheet, so that the toner image is fixed to the sheet. The sheet on which the toner image was fixed is ejected onto a copy receiving tray by a sheet conveying unit.

Sheets take heat from the fixing device during the fixing in the fixing device, so that temperature decreases at each of portions on which the sheets pass by, of the heating roller and the pressure roller. The temperature decrement causes uniformity of temperature distribution in the axial direction. It may cause fixing failure, for example, uniformity of the gross image or the like. Especially when the sheet is a heavy paper or the like, temperature difference is a lot between a portion on which the sheet passes by and a portion on which the sheet does not pass by. It is going to be more likely that fixing failure occurs.

For example, in Documents 1 and 2 below, a technique for equalizing temperature distribution in an axial direction of a heating roller and a pressure roller by installing a heat leveling roller is proposed.

Document 1 below discloses a heat leveling roller (a heat equalizing roller) in which the outermost layer is a release layer, and a brush roller for cleaning the surface of the heat leveling roller. Temperature of the heat leveling roller is set to be higher than melting temperature of toner. The surface of the heat leveling roller is cleaned, by driving the brush roller rotationally. The heat leveling roller can be located at a pressure contact location and a detached location, with respect to the pressure roller. The brush roller can be located at a contact location and a detached location, with respect to the heat leveling roller.

Document 2 below discloses a technique for placing a web cleaning device in a contact state with respect to a hear leveling roller, and for rotating a belt and a pressure roller, when the heat leveling roller contacts with the belt and the pressure roller. Herewith, remaining toner or the like on the pressure roller is moved to the heat leveling roller side, and cleaned by the web cleaning device. The heat leveling roller is movable, and able to reach a state of contact with the pressure roller and the web cleaning device, and a state of detachment from the pressure roller and the web cleaning device.

Toner and paper powder have a property in which they tend to move from a location having high temperature to a location having low temperature. Therefore, toner and paper powder, which adhered to a heating roller or a pressure roller, tend to transferred to a heat leveling roller. Then, the heat leveling roller tends to get dirty. Hence, conventional fixing devices are provided with a brush roller or a web cleaning device, which contacts with a heat leveling roller to clean a surface of the heat leveling roller, as presented above.

DOCUMENTS

[Document 1] Japan Patent Publication No. 2011-22263

[Document 2] Japan Patent Publication No. 2014-48624

The technique of above Document 1 has a problem in which dirt adhered to the heat leveling roller may easily be transferred to the pressure roller again, when the heat leveling roller makes contact with the pressure roller and the brush roller. The retransfer of dirt to the pressure roller may cause creases on paper or the like, since the dirt is fixed to the pressure roller. It makes paper feeding worse.

The technique of above Document 2 uses a web cleaning device as a cleaning part. The web cleaning device includes structures of an elongated cleaning sheet, a cleaning roller, and a cleaning sheet winding mechanism, and so on. It may make the fixing device larger and increase the cost.

This invention is to solve the above problems. The objects is to provide a fixing device and an image forming apparatus with the fixing device, which can prevent the device from becoming larger, and prevent the device from becoming dirty.

SUMMARY OF THE INVENTION

According to this invention, a fixing device comprises a heat rotating body being heated by a heat part, a pressure applying rotating body for fixing a toner image on a recording medium, by forming a nip portion by making contact with the heat rotating body with pressure, and holding and conveying the recording medium carrying the toner image by the nip portion, a heat leveling rotating body for equalizing temperature distribution in the direction of a rotation shaft of a rotating body which is one of the heat rotating body and the pressure applying rotating body, a brush rotating body which includes a plurality of fibers for cleaning a surface of the heat leveling rotating body, a switching unit for switching a contact state between the heat leveling rotating body and the rotating body which is the one of the heat rotating body and the pressure applying rotating body, between a state in which the heat leveling rotating body makes contact with the rotating body and a state in which the heat leveling rotating body is separated from the rotating body, by moving integrally the heat leveling rotating body and the brush rotating body making contact with each other.

BRIEF DESCRIPTION OF THE DRAWINGS

FIG. 5 shows a table of the relationship between pulling out force of the brush and a state of each of the heat leveling roller and the pressure roller.

FIG. 11 shows a table of the relationship between a thickness of fiber 242 in brush 24 and performance of brush 24.

DESCRIPTION OF THE PREFERRED EMBODIMENTS

An embodiment of this invention will be explained in the followings, based on the figures.

In the following embodiments, an image forming apparatus is explained, as it is an MFP (Multifunction Peripheral). An image forming apparatus may be a printer, a copying machine, a facsimile, or the like, other than an MFP.

The First Embodiment

Firstly, a structure of an image forming apparatus according to the embodiment will be explained.

Figure 1:
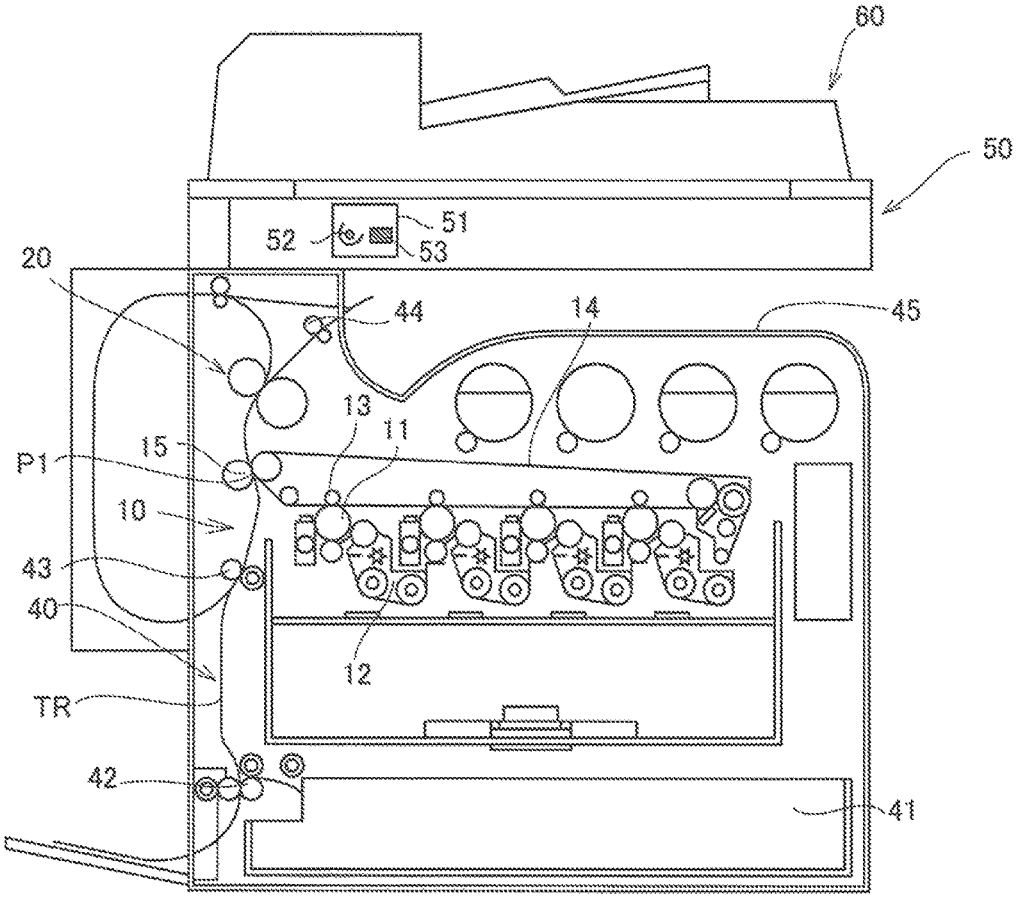
FIG. 1 shows a partial cross section drawing of a structure of an image forming apparatus, according to the first embodiment of this invention.

FIG. 1 shows a partial cross section drawing of a structure of an image forming apparatus, according to the first embodiment of this invention.

Referring to FIG. 1, the image forming apparatus of the embodiment, includes a toner image forming unit 10 (an example of an image forming unit), a fixing device 20, a sheet conveying unit 40, a scanner 50, and an ADF (Auto Document Feeder) 60.

Toner image forming unit 10 synthesizes a four-color image by so-called a tandem system, and transfers the toner image to a sheet. Toner image forming unit 10 includes photo conductors 11, developing devices 12, primary transfer rollers 13, a secondary transfer belt 14, a secondary transfer roller 15, and so on. Photo conductors 11, developing devices 13, and primary transfer rollers 13 are provided for colors of C (cyan), M (magenta), Y (yellow), and K (black). Developing devices 12 form toner images on photo conductors 11. Primary transfer rollers 13 transfer toner images from photo conductors 11 to secondary transfer belt 14 (the primary transfer). Secondary transfer roller 15 transfers toner images at image forming location P1, from secondary transfer belt 14 to sheets (the secondary transfer).

Fixing device 20 melts toner adhered to a sheet, to fix the toner on the sheet, so that an image is formed on the sheet. The detailed structure of fixing device 20 will be explained later.

Sheet conveying unit 40 includes paper feeding cartridge 41, separate unit 42, a pair of conveying rollers 43, a pair of discharge rollers 44, a copy receiving tray 45, and so on. Paper feeding cartridge 41 stores sheets on which images will be formed. A plurality of paper feeding cartridges 41 may be installed. Separate unit 42 separates a sheet from a plurality of sheets stored in paper feeding cartridge 41, and feeds the sheet to conveying path TR. The pair of conveying rollers 43 conveys a sheet along with conveying path TR. The pair of discharge rollers 44 discharges sheets on which images were formed onto a copy receiving tray 45.

A scanner 50 is placed between ADF 60 and copy receiving tray 45. Scanner 50 includes an IR (Infrared) module 51 and so on. IR module 51 includes a lamp 52 to irradiate a document with lights and image sensor 53 to receive reflected light from the document. IR module 51 reads the document image to acquire the image data.

ADF 60 is provided on an upper part of the image forming apparatus. ADF 60 conveys documents on which images will be read by scanner 50 to the image reading location of seamier 59.

Figure 2:
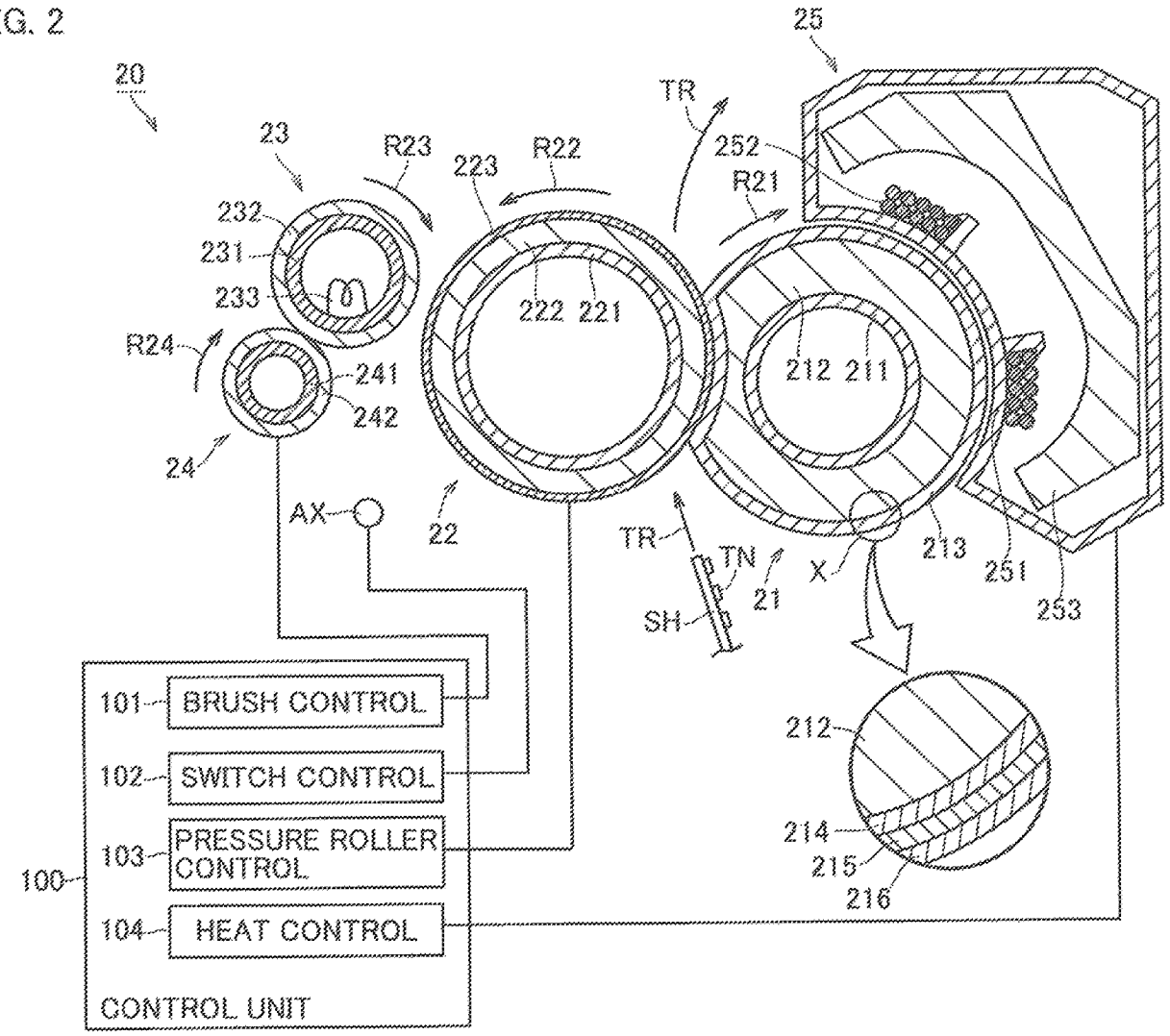
FIG. 2 shows across sectional diagram of a structure of fixing device 20, according to the first embodiment of this invention.

FIG. 2 shows a cross sectional diagram of a structure of fixing device 20, according to the first embodiment of this invention.

Referring to FIG. 2, fixing device 20 includes a heating roller 21 (an example of a heat rotating body), a pressure roller 22 (an example of a pressure applying rotating body), a heat leveling roller 23 (an example of heat, leveling rotating body), a brush 24 (an example of a brush rotating body), magnetic flux generation unit 25 (an example of a heat part), and so on. Fixing device 20 conveys sheet SH (an example of a recording paper s holding toner image TN along with conveying path TR, pinching the sheet SH at a nip portion between heating roller 21 and pressure roller 22. Herewith, toner image TN is melted and fixed on sheet SH. When sheet SH passes through the nip portion between heating roller 21 and pressure roller 22, toner image TN on sheet SH faces heating roller 21.

Heating roller 21 has roller hardness of 30 degree to 90 degree of ASKER-C hardness, for example. Heating roller 21 includes ore metal 211 which is hollow cylindrical, elastic layer 212 formed at an outer circumference of core metal 211, endless belt 213 which is not glued and installed at an outer circumference of elastic layer 212. Core metal 211 is a supporting layer and made of aluminum, for example. In case that heating roller 21 is an induction heating type, to prevent core metal 211 from being heated by electromagnetic induction, cure metal 211 is preferably made of aluminum or the like which is a non-magnetic material.

Elastic layer 212 is made of a silicone sponge material or the like. When a silicone sponge material is used as elastic layer 212, the thickness is preferably in a range from 2 mm to 10 mm, and more preferably in a range from 3 mm to 7 mm. Hardness of elastic layer 212 is preferably in a range from 20 degree to 60 degree measured by using an ASKER rubber hardness tester, and more preferably in a range from 30 degree to 50 degree.

As shown by an enlarged drawing in section X in FIG. 2, endless belt 213 includes electromagnetic induction heating generation layer 214, elastic layer 215, and release layer 216. Electromagnetic induction heating generation layer 214, elastic layer 215, and release layer 216 are laminated in this order from inner circumference to outer circumference.

Electromagnetic induction heating generation layer 214 generates Joule heat by excitation of magnetic flux generation unit 125. Electromagnetic induction heating generation layer 214 is made of a magnetic metal material, for example, nickel electro casting endless belt. Resin containing magnetic metal particles may be used electromagnetic induction heating generation layer 214. The thickness of electromagnet a induction heating generation layer 214 is preferably in a range from 10 μm to 100 μm. more preferably in a range from 20 to 50 μm.

Elastic layer 215 is for improving adhesiveness between sheet SH and a surface of endless belt 213. Elastic layer 215 is made of heat-resistant elastomer or the like, for example, silicone rubber or fluoro-rubber. Elastic layer 215 may contain various fillers to improve heat conductivity, reinforcement, or the like. The thickness of elastic layer 215 is preferably in a range from 10 μm to 800 μm, more preferably in a range from 100 μm to 300 μm. Hardness of elastic layer 215 is preferably in a range of 1 degree to 80 degree of JIS hardness, for example, more preferably in a range from 5 degree to 30 degree.

Release layer 216 is to improve surface releasability of endless belt 213. Release layer 216 is made of fluororesin, for example, silicone rubber or fluoro rubber. The thickness of release layer 216 is preferably in a range from 5 μm to 100 μm, more preferably in a range from 10 μm to 50 μm. Release layer 216 may contain conductive materials, wear resistant materials, high heat conductivity materials or the like, as fillers.

Pressure roller 22 makes contact with heating roller 21, with pressure. Pressure roller 22 forms a nip portion with heating roller 21, to hold and convey sheet SH. Pressure roller 22 has a diameter from 30 to 50 mm, for example. Pressure roller 22 includes hollow cylindrical, core metal 221, elastic layer 222 which is formed on an outer circumference of core metal 221, surface layer 223 which is formed on an outer circumference of elastic layer 222. Core metal 221 is a supporting layer, and made of aluminum, for example. Elastic layer 222 is made of silicone rubber, for example. The thickness of elastic layer 222 is preferably in a range from 2 mm to 5 mm (30 degree JIS-A). Surface layer 223 is made of Tetrafluoroetylene-Perfluoroalkyl (PFA) tube, for example. The thickness of surface layer 223 is preferably in a range from 30 μm to 50 μm.

Heat leveling roller 23 is for equalizing temperature distribution in the direction of the rotation shaft of pressure roller 22. Heat leveling roller 23 can form a nip portion with pressure roller 22, between heat leveling roller 23 and pressure roller 22. Heat leveling roller 23 has a diameter of 15 to 30 mm, for example. Heat leveling roller 23 includes base substance 231 which is hollow and cylindrical, surface layer 232 which is formed on the surface of base substance 231, and halogen heater 233 which is placed in the inner part of base substance 231. Base substance 231 is made of aluminum, for example. Surface layer 232 is made of polytetra fluoro ethylene (PTFE), for example. Halogen heater 233 is ON/OFF controlled, so that the surface of heat leveling roller 23 is maintained at the required temperature.

Heat leveling roller 23 may equalize temperature distribution in the direction of the rotation shaft of one of heating roller 21 and pressure roller 22. Heat leveling roller 23 may not include a heating device, for example, a halogen heater.

Brush 24 cleans the surface of heat leveling roller 23, by rotating (axial rotation). Brush 24 has a diameter of 10 to 20 mm, for example. Brush 24 typically has a diameter of 15.6 mm. Brush 24 includes core metal 241, and a plurality of fibers 242 which cover the surface of core metal 241. Core metal 241 is made of metal, for example, iron. Core metal 241 has a diameter of 10 to 15 mm, for example. Core metal 241 typically has a diameter of 11 mm. Fibers 242 are made of Poly Phenylene Sulfide resin (PBS), for example. The diameter of each of fibers 242 is preferably more than or equal to 10 d (Denier) and equal to or less than 20 d. The diameter of each of fibers 242 is typically 15 d (Denier). The length of each of fibers 242 is 1.6 mm, for example.

Magnetic flux generation unit 25 heats heating roller 21. Magnetic flux generation unit 25 includes coil bobbin 251, coil unit 252, and core unit 253. Coil bobbin 251 is installed being adjacent to heating roller 21, so that coil bobbin 251 covers a part of the outer circumference of heating roller 21. Coil unit 252 winds around coil bobbin 251. Core unit 251 is installed facing coil unit 252. Coil unit 252 is made of a copper cable and so on. Core unit 253 is made of a ferromagnetic substance, for example, ferrite. Coil bobbin 251 is made of resin material, which has high resistance for heat.

Alternating electrical current of 10 kHz to 100 kHz is applied to coil unit 252 of magnetic flux generation unit 25. Herewith, heat is generated at electromagnetic induction heat generation layer 214 of heating roller 21, so that the surface of endless belt 213 is maintained at a prescribed temperature.

Heating roller 21 may be heated by the induction heating method, as presented above. Heating roller 21 may be heated by a resistance heating method. Each of the heat rotating body and the pressure applying rotating body may have a structure using a belt, as substitute for a roller.

In fixing device 20, pressure roller 22 is rotationally driven in the direction shown by arrow R22. Heating roller 21 is driven by pressure roller 22, and rotates in the direction shown by arrow R21. Brush 24 is rotationally driven in the direction shown by arrow R24. When heat leveling roller 23 is separated from pressure roller 22, heat leveling roller 23 stops. When heat leveling roller 23 keeps in contact with pressure roller 22, heat leveling roller 23 is driven by pressure roller 22, and rotates in the direction shown by arrow R23. The rotational direction of the heat leveling roller 23 is opposite to the rotational direction of brush 24.

The above mentioned relationship between the rotational drive and the being driven of the rollers in fixing device 20 is an example. An arbitrary relationship can be adopted.

According to the embodiment, fixing device further includes control unit 100. Control unit 100 is configured with a CPU (Central Processing Unit), ROM (Read Only Memory), RAM (Random Access Memory), and so on. Control unit 100 includes brush control unit 101 (an example of a brush rotating unit), switching control unit 102 (an example of switching unit), pressure roller control unit 103, heat control unit 104, and so on.

Brush control unit 101 controls the rotational drive of brush 24. Switching control unit 102 switches the contact states between heat leveling roller 23 and pressure roller 22 by integrally moving heat leveling roller 23 and brush 24 in the state that heat leveling roller 23 and brush 24 make contact with each other. The contact states includes a state in which heat leveling roller makes contact with pressure roller 22 and a state in which heat leveling roller 23 is separated from pressure roller 22. Pressure roller control unit 103 controls the rotational drive of pressure roller 22. Heat control unit 104 controls alternating electric current applied to coil unit 252 of magnetic flux generation unit 25, to control the temperature of the surface of heating roller 21.

Figure 3:
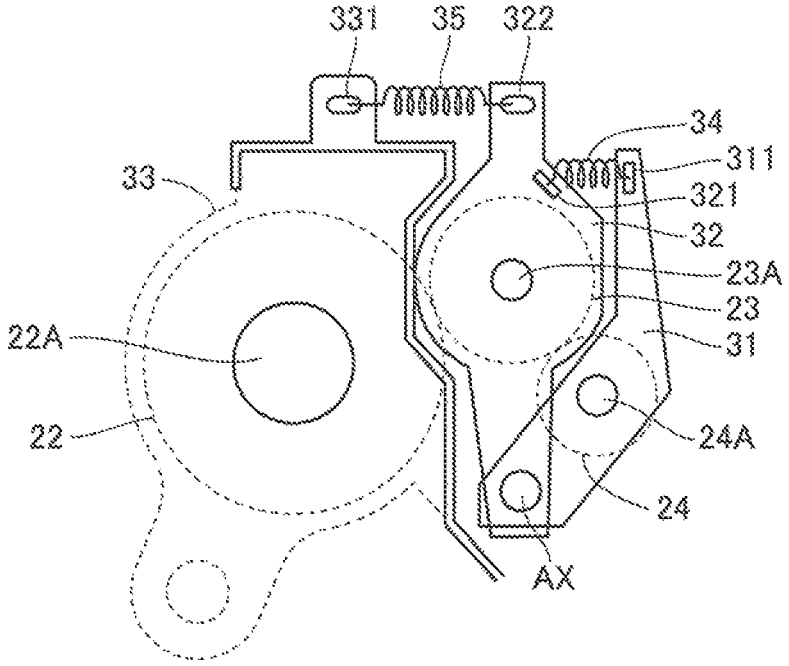
FIG. 3 schematically shows a cross sectional diagram of a structure supporting the rotation shaft of each of pressure roller 22, heat leveling roller 23, and brush 24, according to the first embodiment of this invention.
Figure 6:
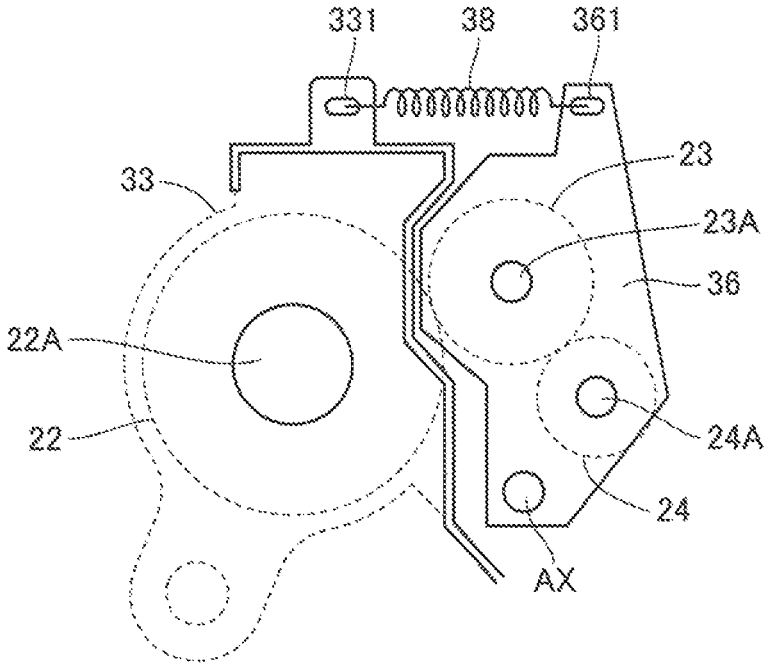
FIG. 6 schematically shows a cross sectional diagram of a structure supporting the rotation shaft of each of pressure roller 22, heat leveling roller 23 and brush 24, according to the second embodiment of this invention.
Figure 9:
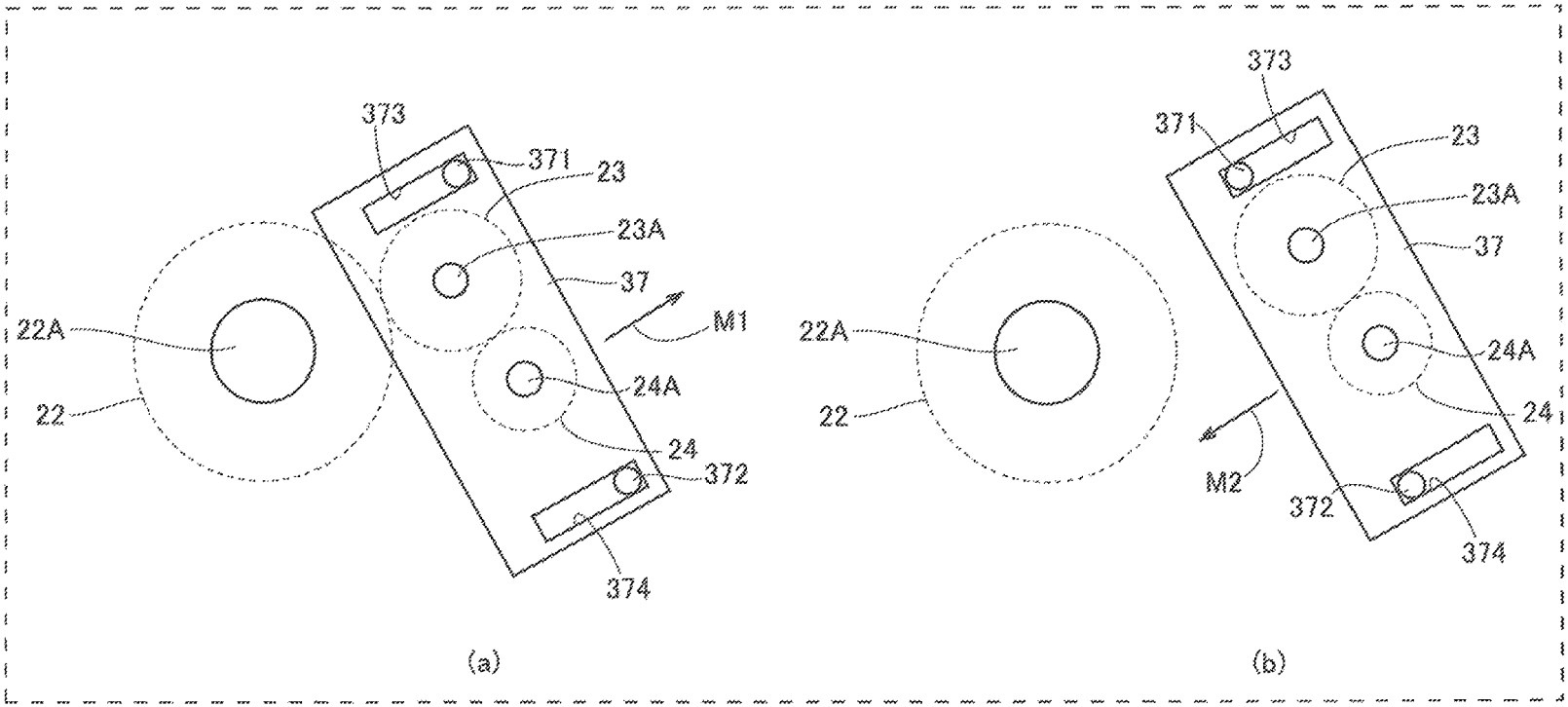
FIG. 9 is for explanation pertaining to a structure supporting the rotation shaft of each of heat leveling roller 23 and brush 24, according to the fourth embodiment of this invention.

FIG. 3 schematically shows a cross sectional diagram of a structure supporting the rotation shaft of each of pressure roller 22, heat leveling roller 23, and brush 24, according to the first embodiment of this invention. FIGS. 3, 6 and 9 show cross sectional diagrams at the one end of pressure roller 22, heat leveling roller 23, and brush 24 shown from the direction of the rotation shaft. In FIGS. 3, 6 and 9, the necessary structures which are not shown by the cross section, are illustrated by dotted lines.

Referring to FIG. 3, fixing device 20 further includes mounting plates 31, 32 and 33, springs 34 and 35.

Mounting plates 31 (an example of a brush rotating body supporting member) hold the rotation shaft 24A of brush 24, making the shaft 24A rotatable. Mounting plate 31 include a hole 311 for the spring, which is made above rotation shaft 24A, and switching rotation shaft AX. Mounting plates 31 are provided at both ends of rotation shaft 24A in the axial direction.

Mounting plates 32 (an example of a heat leveling rotating body supporting member) hold the rotation shaft 23A of heat leveling roller 23, making the shaft 23A rotatable. Mounting plates 32 include holes 321 and 322 for the springs, which are made above rotation shaft 23A. Mounting plates 32 are provided at both ends of rotation shaft 23A in the axial direction.

Mounting plates 33 (an example of a pressure applying rotating body supporting member) hold the rotation shaft 22A of pressure roller 22, making the shaft 22A rotatable. Mounting plate 33 includes a hole 331 for the spring, which is made above rotation shaft 22A. Mounting plates 33 are provided at both ends of rotation shaft 23A in the axial direction.

One end of spring 34 (an example of a first energization part) is fixed to hole 311 for the spring. The other end of spring 34 is fixed to hole 321 for the spring. Spring 34 is provided between mounting plate 31 and mounting plate 32, being extended from the natural length. Herewith, spring 34 is energized in a direction to push brush 24 to heat leveling roller 23. Heat leveling roller 23 and brush 24 (in other words, mounting plates 31 and 32) can integrally swing about switching rotation shaft AX, by the action of spring 34. Switching rotation shaft AX is different from rotation shaft 24A.

One end of Spring 35 (an example of a second energization part) is fixed to hole 122 for the spring. The other end of spring 35 is fixed to hole 331 for the spring. Spring 35 is provided between mounting plate 32 and mounting plate 33, being extended from the natural length. Herewith, spring 35 is energized in a direction to push heat leveling roller 23 to pressure roller 22. By swinging mounting plate 32 in a direction to be separated from pressure roller 22, mounting plate 32 and mounting plate 31 can integrally swing about switching rotation shaft AX.

Figure 4:
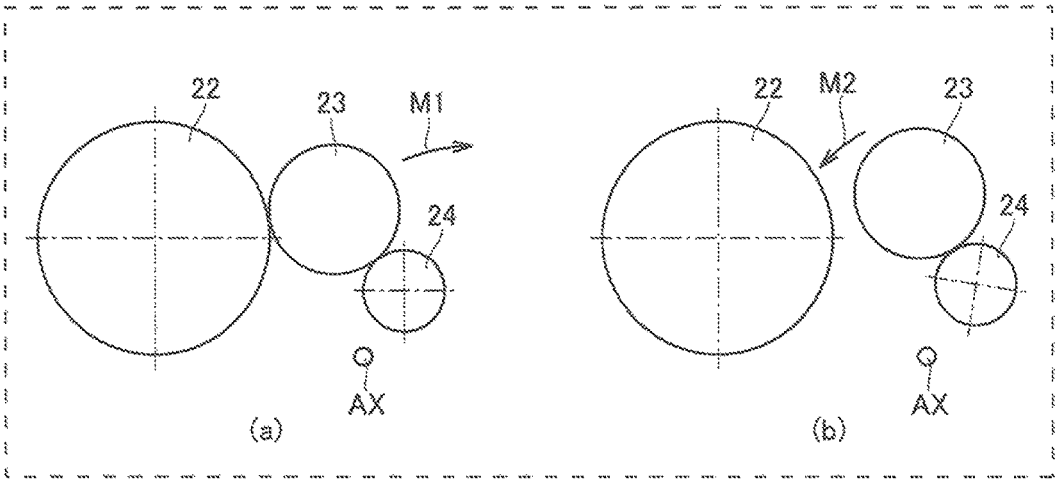
FIG. 4 is schematically for explanation pertaining to switching a contact state of pressure roller 22 and heat leveling roller 23, according to the first embodiment of this invention.

FIG. 4 is schematically for explanation pertaining to switching a contact state of pressure roller 22 and heat leveling roller 23, according to the first embodiment of this invention. FIG. 4(*a*) shows a state in which heat leveling roller 23 makes contact with pressure roller 22. FIG. 4(*b*) shows a state in which heat leveling roller 23 is separated from pressure roller 22.

Referring to FIG. 4, when uniformalization of the temperature distribution of pressure roller 22 in the axial direction is completed, switching control unit 102 switches the contact state of heat leveling roller 23 from the state of FIG. 4(*a*) to the state of FIG. 4(*b*). Switching control unit 102 integrally swings (moves) heat leveling roller 23 and brush 24 about switching rotation shaft AX, as shown by arrow M1.

According to the state of FIG. 4(*b*), since heat leveling roller 23 is separated from pressure roller 22, dirt adhered to heat leveling roller 23 can not be retransferred to pressure roller 22. In the state in which heat leveling roller 23 is separated from pressure roller 22, brush control unit 101 may rotate brush 24.

When the temperature distribution of pressure roller 22 in an axial direction is to be equalized, switching control unit 102 switches the contact state of heat leveling roller 23 from the state of FIG. 4(*b*) to the state of FIG. 4(*a*). Switching control unit 102 integrally swings (moves) heat leveling roller 23 and brush 24 about switching rotation shaft AX, as shown by arrow M2.

According to the state of FIG. 4(*a*), since heat leveling roller 23 keeps in contact with pressure roller 22, the temperature distribution of pressure roller 22 in an axial direction is uniformalized by heat leveling roller 23. The contact pressure between heat leveling roller 23 and pressure roller 22 is set as an appropriate value.

Since heat leveling roller 23 and brush 24 swing integrally at all times, the contact pressure between brush 24 and heat leveling roller 23 is maintained within a predetermined range. Herewith, even though heat leveling roller 23 keeps in contact with pressure roller 22, readhesion of dirt to pressure roller 22 is prevented, due to the following reasons.

The nip pressure between heating roller 21 and pressure roller 22 may be set at a plurality of different values. Control unit 100 may set the nip pressure at an appropriate value corresponding to the type of the sheet to be transported.

Some image forming apparatuses may have an envelope mode as a print mode. The envelope mode is to make the nip pressure between heating roller 21 and pressure roller 22 lower than the normal nip pressure and to execute fixing, when printing on an envelope, so that the envelope is prevented from being crumpled. Since an envelope is made of two papers overlapped, it is thick. Further, an envelope is usually narrow and the size is usually small. Therefore, when an envelope is conveyed in a nip portion between heating roller 21 and pressure roller 22, the temperature distribution of heating roller 21 in the direction of the rotation axis lends to be ununiform. Hence, switching control unit 102 may perform a control in which heat leveling roller 23 is placed in contact with pressure roller 22 at all times of printing, when printing in the envelope mode.

According to this embodiment, since a surface of the heat leveling roller is cleaned by a brush, the fixing device is prevented from becoming larger, as compared with a fixing device using a web cleaning device. According to this embodiment, the heat leveling rotating body and the brush rotating body integrally swing, making contact with each other. It can prevent the pressure roller from readhesion of dirt. It can also prevent the occurrence of failure in feeding paper.

The inventor of this patent application found out the cause of the problem in which dirt adhered to the heat leveling roller is retransferred to the pressure roller, in the technique of Document 1, as follows. When fixing toner on a sheet, a part of the toner and the paper powder adheres to the pressure roller. A part of the toner and the paper powder is transferred to the heat leveling roller. In case that pressure (brush pressure) of the brush which makes contact with the heat leveling roller is high, the surface layer of the heat leveling roller becomes worn and the release characteristics becomes degraded, so that the toner and the paper powder are fixed to the heat leveling roller. A part of the toner and the paper powder is also retransferred and fixed to the pressure roller. In consequence, the pressure roller becomes contaminated.

The inventor of this patent application found out that the occurrence of the mixture is prevented, by keeping the contact pressure between the heat leveling roller and the brush within the predetermined range, based on the mechanism set forth in the previous paragraphs. The inventor of this patent application also found out that it has effect to prevent the dirt from being transferred from the heat leveling roller to the pressure roller.

FIG. 5 shows a table of the relationship between pulling out force of the brush and a state of each of the heat leveling roller and the pressure roller. The pulling out force of the brush means force required to pull out a paper when the paper is pinched by the heat leveling roller and the brush. The pulling out force of the brush is a value being proportionate to the contact pressure between the heat leveling roller and the brush.

Referring to FIG. 5, when the pulling out force of the brush is more than or equal to 5 gf and is equal to or less than 14 gf the dirt of the heat leveling roller is adequately removed, and retransfer of dirt to the pressure roller is prevented. On the other hand, when the pulling out force of the brush is equal to or less than 4 gf, the dirt of the heat leveling roller is not removed and remains. When the pulling out force of the brush is more than or equal to 15 gf the PTFE coating on a surface of the heat leveling roller is scraped, and the toner and the paper powder is fixed to the heat leveling roller, so that the dirt is retransferred to the pressure roller. According to the result the retransfer of the dirt to the pressure roller is prevented, by configuring the contact pressure between the heat leveling roller and the brush, so that the pulling out force of the brush is within a range in which the pulling out force of the brush is more than or equal to 5 gf and is equal to or less than 14 gf.

According to the technique of the above mentioned Document 1, each of the heat leveling roller and the brush roller can independently be moved. Therefore, according to the technique of the above mentioned Document 1, it is difficult to keep both the contact pressure between the pressure roller and the heat leveling roller, and the contact pressure between the heat leveling roller and the brush, within preferable ranges.

On the other hand, according to this embodiment, the heat leveling roller and the brush make contact with each other at all times. Therefore, it can make it easier to keep the contact pressure between the heat leveling roller and the brush within the above mentioned range suitable for cleaning dirt by the brush. In consequence, the retransfer of the dirt to the pressure roller can be prevented.

In addition, the retransfer of the dirt from the heat leveling roller to the pressure roller can be further reduced, by separating the heat leveling roller from the pressure roller at a necessary timing. In particular, when the brush rotates in a state that the heat leveling roller is separated from the pressure roller, the heat leveling roller can be cleaned in a state that the heat leveling roller is separated from the pressure roller. In consequence, the retransfer of the dirt from the heat leveling roller to the pressure roller can be prevented, when the state is changed to a state in which the heat leveling roller makes contact with the pressure roller again.

Further, the fluctuation of contact pressure between heat leveling roller 23 and brush 24 caused by thermal expansion of heat leveling roller 23 can be prevented, by energizing brush 24 by spring 34 in a direction in which brush 24 is pressed against heat leveling roller 23.

The Second Embodiment

FIG. 6 schematically shows a cross sectional diagram of a structure supporting the rotation shaft of each of pressure roller 22, heat leveling roller 23, and brush 24, according to the second embodiment of this invention.

Referring to FIG. 6, according to the embodiment, heat leveling roller 23 and brush 24 are rotatably supported by a same part, mounting plate 36.

Fixing device 20 includes mounting plates 33 and 36, and spring 38. Mounting plate 36 supports the rotation shaft 23A of heat leveling roller 23 and the rotation shaft 24A of brush 24 rotatably. Mounting plate 36 includes hole 361 for the spring which is opened above the rotation shafts 23A and 24A, and switching rotation shaft AX. Mounting plates 36 are provided at both ends in an axial direction of the rotation shafts 23A and 24A.

Mounting plate 33 supports the rotation shaft 22A of pressure roller 22 rotatably. Mounting plate 33 includes hole 331 for the spring above the rotation shaft 22A. Mounting plates 33 are provided at both ends in an axial direction of the rotation shaft 22A.

One end of spring 38 is fixed at hole 361 for the spring. The other end of spring 38 is fixed at hole 331 for the spring. Spring 38 is provided between mounting plate 36 and mounting plate 33, being expanded from the natural length. Herewith, spring 38 is energized so that heat leveling roller 23 is pressed against pressure roller 22.

Figure 7:
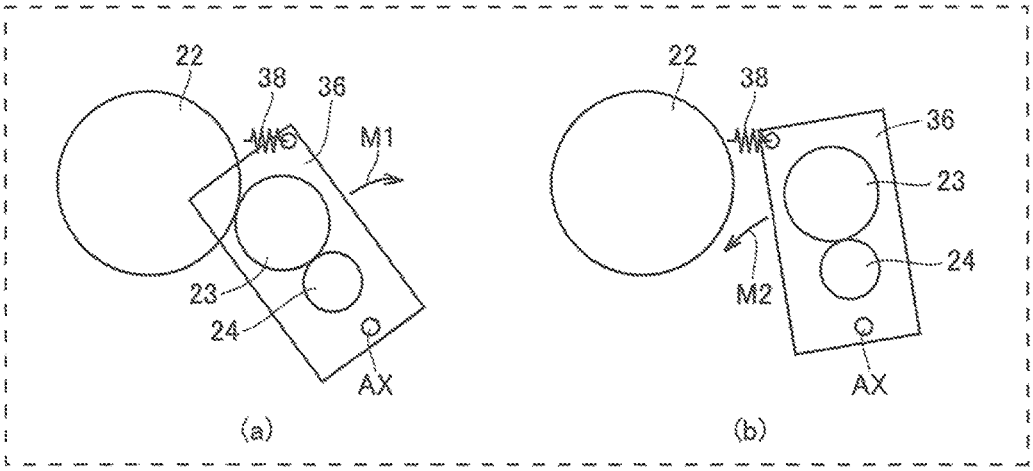
FIG. 7 is schematically for explanation pertaining to switching of the contact state between pressure roller 22 and heat leveling roller 23, according to the second embodiment of this invention.

FIG. 7 is schematically for explanation pertaining to switching of the contact state between pressure roller 22 and heat leveling roller 23, according to the second embodiment of this invention. FIG. 7(*a*) shows a state in which heat leveling roller 23 makes contact with pressure roller 22. FIG. 7(*b*) shows a state in which heat leveling roller 23 is separated from pressure roller 22.

Referring to FIG. 7, heat leveling roller 23 and brush 24 are supported rotatably by the same part, mounting plate 36. Similar to the first embodiment shown by FIG. 4, heat leveling roller 23 and brush 24 integrally swing (move) about switching rotation shaft AX.

More specifically, when the uniformalization of temperature distribution in an axial direction of pressure roller 22 is completed, switching control unit 102 switches the contact state of heat leveling roller 23 from the state of FIG. 7(*a*) to the state of FIG. 7(*b*). Switching control unit 102 integrally swings (moves) heat leveling roller 23 and brush 24 about switching rotation shaft AX, as shown by arrow M1.

When temperature distribution in an axial direction of pressure roller 22 is to be equalized, switching control unit 102 switches the contact state of heat leveling roller 23 from the state of FIG. 7(*b*) to the state of FIG. 7(*a*). Switching control unit 102 integrally swings (moves) heat leveling roller 23 and brush 24 about switching rotation shaft AX, as shown by arrow M2.

Since the structure of the image forming apparatus and the fixing device other than the above mentioned is similar to the first embodiment, the same numerals are provided for same components and the explanation is not repeated.

According to this embodiment, the effect similar to the first embodiment can be obtained. In addition, since heat leveling roller 23 and brush 24 are rotatably supported by the same part, mounting plate 36, the distance between heat leveling roller 23 and brush 24 (the distance between the shafts) is maintained. In consequence, adopting the simpler structure, the fluctuation of the distance between heat leveling roller and brush 24 caused by switching the contact state of heat leveling roller 23 and brush 24 can be prevented.

The Third Embodiment

Figure 8:
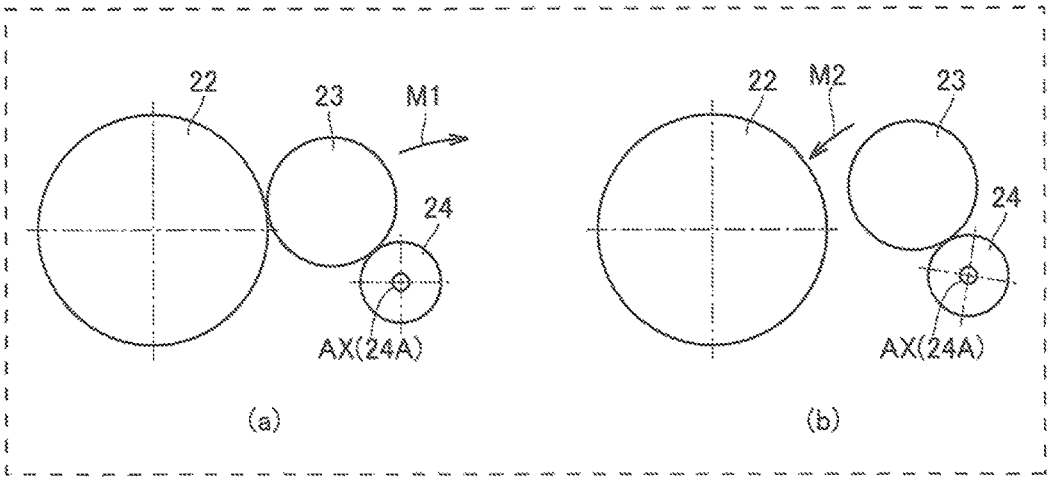
FIG. 8 is schematically for explanation pertaining to switching of the contact state between pressure roller 22 and heat leveling roller 23, according to the third embodiment of this invention.

FIG. 8 is schematically for explanation pertaining to switching of the contact state between pressure roller 22 and heat level tug roller 23, according to the third embodiment of this invention. FIG. 8(*a*) shows the state in which heat leveling roller 23 makes contact with pressure roller 33. FIG. 8(*b*) shows the state in which heat leveling roller 23 is separated from pressure roller 22.

Referring to FIG. 8, according to the embodiment, switching rotation shaft AX and the rotation shaft 24A of brush 24 are the same. Heat leveling roller 23 and brush 24 integrally swing about switching rotation shaft AX. During the swinging, brush 24 does not change the location and rotates axially at the location.

More specifically, when the uniformalization of the temperature distribution in an axial direction of pressure roller 22 is completed, switching control unit 102 switches the contact state of heat leveling roller 23 from the state of FIG. 8(*a*) to the state of FIG. 8(*b*). Switching control unit 102 moves heat leveling roller 23 about switching rotation shaft AX, as shown by arrow M1, and rotates brush 24 axially at the location, as shown by arrow M1.

When the temperature distribution in an axial direction of pressure roller 22 is to be equalized, switching control unit 102 switches the contact state of heat leveling roller 23 from the state of FIG. 8(*b*) to the state of FIG. 8(*a*). Switching control unit 102 moves heat leveling roller 23 about switching rotation shaft AX, as shown by arrow M2, and rotates brush 24 axially at the location, as shown by arrow M2.

Since the structure of the image forming apparatus and the fixing device other than the above mentioned is similar to the first embodiment, the same numerals are provided for same components and the explanation is not repeated.

According to this embodiment, the effect similar to the first embodiment can be obtained. In addition, since switching rotation shaft AX and the rotation shaft 24A of brush 24 are the same shaft, the swing radius of heat leveling roller 23 and brush 24 can be smaller.

The Fourth Embodiment

FIG. 9 is for explanation pertaining to a structure supporting the rotation shaft of each of heat leveling roller 23 and brush 24, according to the fourth embodiment of this invention. FIG. 9(*a*) shows the state in which heat leveling roller 23 makes contact with pressure roller 22. FIG. 9(*b*) shows the state in which heat leveling roller 23 is separated from pressure roller 22.

Referring to FIG. 9, according to the embodiment, heat leveling rolling 23 and brush 24 integrally move parallely, keeping contact with each other.

Fixing device 20 includes mounting plate 37. Mounting plate 37 rotatably supports the rotation shaft 23A of heat leveling roller 23 and the rotation shaft 24A of brush 24. Mounting plate 37 includes fitting groove 373 opened above the rotation shafts 23A and 24A, and fitting groove 374 opened below the rotation shafts 23A and 24A. Fitting groove 373 engages with protrusion 371 being fixed to a chassis of the image forming apparatus. Protrusion 371 can slide in fitting groove 373, and can engage with fitting groove 373 at an arbitrary location in fitting groove 373. Fitting groove 374 engages with protrusion 372 being fixed to a chassis of the image forming apparatus. Protrusion 372 can slide in fitting groove 374, and can engage with fitting groove 374 at an arbitrary location in fitting groove 374. Mounting plates 37 are provided at both ends of the rotation shafts 23A and 24A in an axial direction.

According to the embodiment, heat leveling roller 23 and brush 24 integrally move parallely, between the state of FIG. 9(*a*) and state of FIG. 9(*b*).

More specifically, when the uniformalization of the temperature distribution in an axial direction of pressure roller 22 is completed, switching control unit 102 switches the contact state of heat leveling roller 23 from the state of FIG. 9(*a*) to the state of FIG. 9(*b*). By sliding each of protrusions 371 and 372 in each of the inner parts of fitting grooves 373 and 374, switching control unit 102 moves heat leveling roller 23 and brush 24 with respect to protrusions 371 and 372, as shown by arrow M2.

When the temperature distribution in an axial direction of pressure roller 22 is to be equalized, switching control unit 102 switches the contact state of heat leveling roller 23 from the state of FIG. 9(*b*) to the state of FIG. 9(*a*). By sliding each of protrusions 371 and 372 in each of the inner parts of fitting grooves 373 and 374, switching control unit 102 moves heat leveling roller 23 and brush 24 with respect to protrusions 371 and 372, as shown by arrow M2.

Since the structure of the image forming apparatus and the fixing device other than the above mentioned is similar to the first embodiment, the same numerals are provided for same components and the explanation is no repeated.

According to this embodiment, the effect similar to the first embodiment can be obtained.

The Fifth Embodiment

Figure 10:
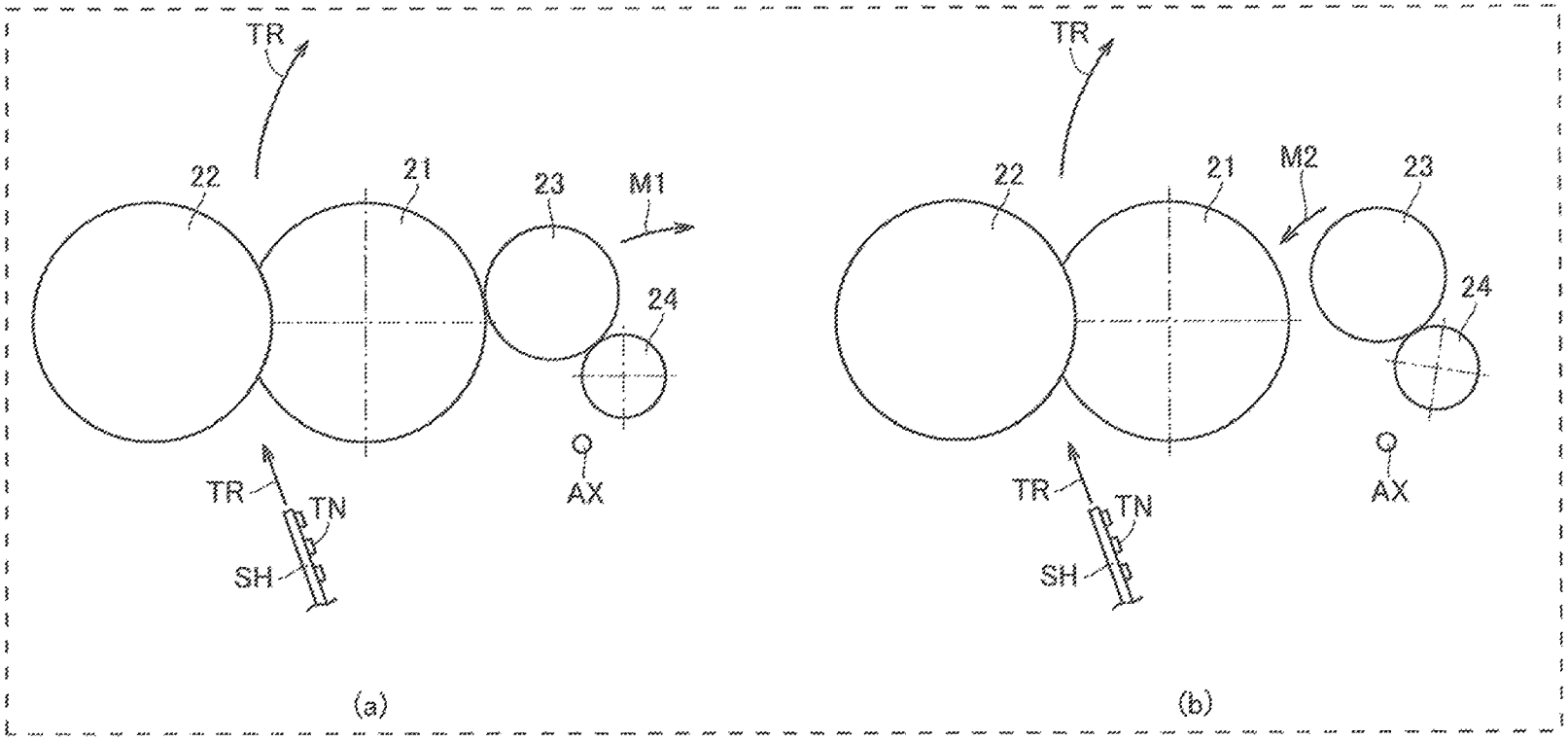
FIG. 10 is schematically for explanation pertaining to switching of the contact state between heating roller 21 and heat leveling roller 23, according to the fifth embodiment of this invention.

FIG. 10 is schematically for explanation pertaining to switching of the contact state between heating roller 21 and heat leveling roller 23, according to the fifth embodiment of this invention. FIG. 10(*a*) shows the state in which heat leveling roller 23 makes contact with heating roller 21. FIG. 10(*b*) shows the state in which heat leveling roller 23 is separated from heating roller 21.

Referring to FIG. 10, according to the embodiment, the object of temperature distribution equalizing by heat leveling roller 23 in the direction of the rotation shaft is not pressure roller 22, but heating roller 21. Heat leveling roller 23 can make a nip portion with heating roller 21. By moving heat leveling roller 23 and brush 24 integrally making contact with each other, switching control unit 102 switches the contact state of heat leveling roller 23 and heating roller 21 between the state in which heat leveling roller 23 makes contact with heating roller 21 and the state in which heat leveling roller 23 is separated from heating roller 21. According to the embodiment, when sheet SH passes through the nip portion between heating roller 21 and pressure roller 22, it is supposed that toner images TN on sheet SH faces heating roller 21.

More specifically, when the an uniformalization of the temperature distribution in an axial direction of heating roller 21 is completed, switching control unit 102 switches the contact state of heat leveling roller 23 from the state of FIG. 10(*a*) to the state of FIG. 10(*b*). Switching control unit 102 integrally swings (moves) heat leveling roller 23 and brush 24 about switching rotation shaft AX, as shown by arrow M1.

When the temperature distribution in an axial direction of heating roller 21 is to be equalized, switching control unit 102 switches the contact state of heat leveling roller 23 from the state of FIG. 10(*b*) to the state of FIG. 10(*a*). Switching control unit 102 integrally swings (moves) heat leveling roller 23 and brush 24 about switching rotation shaft AX, as shown by arrow M2.

Since the structure of the image forming apparatus and the fixing device other than the above mentioned is similar to the first embodiment, the same numerals are provided for same components and the explanation is not repeated.

According to this embodiment, by the effect similar to the first embodiment, the retransfer of dirt from the heat leveling roller to the heating roller can be prevented.

The Sixth Embodiment

The inventor of this patent application changed thickness (brush diameter) of each of a plurality of fibers 242 in brush 24 within a predetermined range, in the structure of fixing device 20 of the first embodiment shown in FIG. 2, and investigated performance of brush 24 for each the cases. The result of the investigation is shown in FIG. 11.

FIG. 11 shows a table of the relationship between the brush diameter in brush 24 and performance of brush 24.

Referring to FIG. 11, when the brush diameter is 5*d*, the pulling out force is unstable, since the elasticity of the brush is weak. When the brush diameter is 75 d, the coating of the surface of the heat leveling roller wore down, since the elasticity of the brush is too strong. On the other hand, when the brush diameter is 10 d, 15 d, or 20 d, dirt on the heat leveling roller is adequately removed and it produced an excellent result. According to the result, the thickness of each of a plurality of fibers 242 in brush 24 should preferably be more than or equal to 10 d and be equal to or less than 20 d.

Others

The above mentioned embodiments can be combined appropriately. For example, the structure in which heat leveling roller 23 makes contact with heating roller 21 in the fifth embodiment can be adopted to the structure of each of the first to the fourth and the sixth embodiments.

The processes of above embodiments may be performed by software or a hardware circuit. A computer program which executes the processes in the above embodiments can be provided. The program may be provided recorded in recording media of CD-ROMs, flexible disks, hard disks, ROMs, RAMs, memory cards, or the like to users. The program is executed by a computer of a CPU or the like. The program may be downloaded to a device via communication lines like the internet. The processes explained in the above flowcharts and the description are executed by a CPU in line with the program.

Effect of the Embodiment

According to the embodiments, a fixing device and an image forming apparatus being equipped with the same which can prevent dirt without becoming larger, can be provided.

Although the present invention has been described and illustrated in detail it is clearly understood that the same is by way of illustration and example only and is not to be taken by way of limitation, the spirit and scope of the present invention being limited only by the terms of the appended claims.

What is claimed is:

1. A fixing device comprising:

a heat rotating body being heated by a heat part, a pressure applying rotating body for fixing a toner image on a recording medium, by forming a nip portion by making contact with the heat rotating body with pressure, and holding and conveying the recording medium carrying the toner image by the nip portion, a heat leveling rotating body for equalizing temperature distribution in a direction of a rotation shaft of a rotating body which is one of the heat rotating body and the pressure applying rotating body, a brush rotating body which includes a plurality of fibers for cleaning a surface of the heat leveling rotating body, a switch for switching a contact state between the heat leveling rotating body and the rotating body which is the one of the heat rotating body and the pressure applying rotating body, between a state in which the heat leveling rotating body makes contact with the rotating body, and a state in which the heat leveling rotating body is separated from the rotating body so that the heat leveling rotating body does not contact the heat rotating body and does not contact the pressure applying rotating body, by moving the heat leveling rotating body while the heat leveling rotating body remains in contact with the brush rotating body, a heat leveling rotating body supporting member for supporting a rotation shaft of the heat leveling rotating body rotatably, a brush rotating body supporting member for supporting a rotation shaft of the brush rotating body rotatably, a pressure applying rotating body supporting member for supporting a rotation shaft of the pressure applying rotating body rotatably, a first energization part installed between the heat leveling rotating body supporting member and the brush rotating body supporting member, and a second energization part installed between the heat leveling rotating body supporting member and the pressure applying rotating body supporting member, wherein the switch switches the contact state between the heat leveling rotating body and the rotating body by swinging the heat leveling rotating body and the brush rotating body integrally about a switching rotation shaft, the first energization part energizes the brush rotating body in a direction in which the brush rotating body is pressed against the heat leveling rotating body, and the second energization part energizes the heat leveling rotating body in a direction in which the heat leveling rotating body is pressed against the pressure applying rotating body.

2. The fixing device according to claim 1, wherein the switching rotation shaft and the rotation shaft of the brush rotating body are different from each other, and the switch switches the contact state between the heat leveling rotating body and the rotating body by moving both of the heat leveling rotating body and the brush rotating body.

3. The fixing device according to claim 1, further comprising:

a brush rotating unit for rotating the brush rotating body, in a state in which the heat leveling rotating body is separated from the rotating body which is the one of the heat rotating body and the pressure applying rotating body.

4. The fixing device according to claim 1, wherein a diameter of each of the plurality of fibers in the brush rotating body is more than or equal to 10 denier and is equal to or less than 20 denier.

5. An image forming apparatus comprising:

a printer for transferring the toner image to the recording medium, and the fixing device according to claim 1.

6. The fixing device according to claim 1, wherein the switch switches the contact state between the heat leveling rotating body and the rotating body by moving the heat leveling rotating body while maintaining a constant distance between the rotation shaft of the heat leveling rotating body and the rotation shaft of the brush rotating body.

7. The fixing device according to claim 6, wherein the heat leveling rotating body directly contacts the pressure applying body in the state in which the heat leveling rotating body makes contact with the rotating body, and the heat leveling rotating body is separated from and does not contact the pressure applying body in the state in which the heat leveling rotating body is separated from the rotating body.

* * * * *